United States Patent [19]

Gaeta et al.

[11] Patent Number: 4,973,338

[45] Date of Patent: Nov. 27, 1990

[54] ANTI-STATIC AND LOADING ABRASIVE COATING

[75] Inventors: Anthony C. Gaeta, Lockport; Alex J. Dean, Niagara Falls, both of N.Y.

[73] Assignee: Carborundum Abrasives Company, Niagara Falls, N.Y.

[21] Appl. No.: 373,999

[22] Filed: Jun. 29, 1989

[51] Int. Cl.[5] ..... B24D 11/00

[52] U.S. Cl. ..... 51/295; 51/298; 252/155

[58] Field of Search ..... 51/295, 298; 252/155

[56] References Cited

U.S. PATENT DOCUMENTS 2,284,716 6/1942 Benner et al. ..... 51/295
2,768,886 10/1956 Twombly ..... 51/295
4,396,403 8/1983 Ibrahim ..... 51/295
4,751,138 6/1988 Tumey et al. ..... 51/295

FOREIGN PATENT DOCUMENTS 1243578 4/1970 United Kingdom .

*Primary Examiner*—William R. Dixon, Jr.
*Assistant Examiner*—Willie Thompson
*Attorney, Agent, or Firm*—Michael L. Dunn; William J. Crossetta

[57] ABSTRACT

A coated abrasive is disclosed that has been oversized with an anti-loading amount of a quaternary ammonium anti-static compound, comprising from about 15 to about 35 carbon atoms and a molecular weight not less than about 300, have been found to have a combination of anti-static, lubricity and anti-loading characteristics which provide improved abrading efficiency and longer abrading life.

29 Claims, No Drawings

ANTI-STATIC AND LOADING ABRASIVE COATING

This invention relates to new coated abrasive products and a method for manufacturing coated abrasive products having improved anti-static and anti-loading properties.

BACKGROUND OF THE INVENTION

The coated abrasive products industry is continuously seeking new and better means to satisfy the continuing demand for fast, efficient and durable abrading products.

By coated abrasives it is generally meant to describe those products having abrasive granules adhered to a supporting backing which can be used to abrade or otherwise wear down the surface of an article on which they are worked and which typically are generically referred to as sandpaper. The support backing may be rigid, but generally is flexible and typically comprises a fibrous material such as cloth or paper. The abrasive granules generally comprise a particulate material typically having sharp cutting edges and the capability of abrading the material from which the article to be abraded is manufactured. The granules typically are adhered to the support backing by an adhesive binder material and the like.

A continuing problem with coated abrasives is that they are typically used during a manufacturing process to abrade the surface of products comprised of soft materials such as aluminum, wood, plastic and the like wherein the abraded material from the product, and/or softened material from the binder or support backing, undesirably adheres around and about the granules in such manner as to build-up, clog or otherwise reduce the effective abrading surface of the coated abrasive and accordingly the efficiency of the abrading process.

Multiple factors contribute to such build-up or clogging of adhering materials about the abrasive granules and the resulting loss in efficiency of the coated abrasive. Some primary factors include static charge build-up on the coated abrasive which attracts abraded particles and retains them to the coated abrasive; overheating of the coated abrasive which may cause material from the abraded article to burn or otherwise accumulate around and about the cutting surfaces of the granules; overheating of the binder or support backing which may cause them to soften; and, loading build-up which comprises the natural adhering tendency of the material, or components thereof, being abraded to otherwise accumulate about the granules of the coated abrasive.

Thus, when the article to be abraded or sanded is comprised of a material such as wood, particularly wood which may have been filled and/or sealed, abrading the article with a conventional coated abrasive typically results in the clogging of the coated abrasive within a relatively short period of time due to the adhering of natural lignins, the sealer or filler compositions typically caused by the heat generated during the abrading process. Where the abrading process is by machine sanding or abrading, such as by continuous belt, disk sanding techniques and the like, a coated abrasive can become more rapidly clogged. In such circumstance, the machine abrading process not only becomes inefficient but there is increased difficulty in controlling the flow of machine abraded particulate matter into collectors. Since the collection of abraded particulate matter is important to control as it may create environmental concerns, the problem extends itself beyond manufacturing efficiencies. Hence, the machine abrading of products comprised of materials such as wood can require premature changing of the coated abrasive belts, disks and the like to satisfy environmental regulations relating to the collection of dust particles as well as manufacturing efficiencies. The result is increased material and labor cost to the manufacturer.

Various means have been devised to reduce the incidence of build-up or clogging on coated abrasives. Chemical additives, generically referred to as "sanding aids", have been incorporated in some sealing and filling compositions for application to materials such as wood, which indeed reduce the incidence of clogging of the coated abrasive. Invariably however, since such aids are applied directly to the wood, they are found to detract from the natural beauty of the finished product. Because of such problem other means have been proposed for use which avoid using materials such as sanding aids that are applied to the article to be abraded.

U.S. Pat. No. 2,768,886 describes the application of metallic soaps to the coated abrasive for the reduction of clogging. Such application does appear to decrease the incidence of clogging and is widely used in the industry, but is considered less efficient than desired.

U.S. Pat. No. 4,396,403, discloses the incorporating of phosphoric acids, partial esters of such acids, amine salts of such acids, quaternary ammonium salts and the like to the size coating of coated abrasives to achieve the loading resistance attained by the use of metal stearates. Such process is also used in the industry but is generally considered less effective than desired.

An object of this invention is to provide a convenient means to improve resistance to static build-up on a coated abrasive.

Another object of the invention is to provide a convenient means to improve resistance to loading build-up on a coated abrasive.

Still another object of the invention is to provide a coated abrasive having improved anti-static and improved anti-loading characteristics, particularly for machine abrading applications.

These and other objects of the invention will become apparent from the following.

SUMMARY OF THE INVENTION

The present invention is based upon the surprising finding that coated abrasive materials, when oversized with an appropriate amount of a quanternary ammonium anti-static compound, comprising from about 15 to about 35 carbon atoms and a molecular weight not less than about 300, have been found to have a combination of anti-static, lubricity and anti-loading characteristics which provide, improved abrading efficiency and longer abrading life. Particularly effective abrading efficiencies may be attained by oversizing a coated abrasive with an anti-loading amount of a quaternary ammonium anti-static compound, selected from the group consisting of (3-lauramido-propyl)trimethylammonium methylsulfate, stearamidopropyldimethyl-$\beta$-hydroxyethylammoniumnitrate, N,N-bis(2-hydroxyethyl)-N-(3'-dodecyloxy-2'-hydroxypropyl)methylammonium methosulfate and stearamidopropyl-dimethyl-$\beta$-hydroxyethyl-ammoniumdihydrogen phosphate. It has been found that coated abrasive materials, thus treated, have an extended usable abrading life well beyond typical performance parameters of untreated coated abrasives, and provide significant savings in both cost and labor to the user.

DETAILED DESCRIPTION OF THE INVENTION

Coated abrasives generally comprise those products having abrasive granules adhered to a supporting backing which can be used to abrade or otherwise wear down the surface of an article to which they are applied.

The supporting backing of a coated abrasive may be rigid, but generally is flexible and typically comprises a web of material such as paper, cloth, fibrous pad, polymeric film, vulcanized fiber, metallic net or a combination of such materials and the like. In some applications, the supporting backing initially comprises a collection of loose fibers, to which the abrasive granules are added, with or without further binder material, to provide an abrasive web having granules throughout. The loose collection of fibers and granules may be compressed, if no adhering binder is present, or otherwise fixed or cured when a binder is present to form the coated abrasive The abrasive granules can generally be any material which has the capability of abrading the workpiece article and typically includes sand, flint, corundum, metallic oxides such as aluminum oxides, aluminum-zirconia, ceramic alumina, diamond, silicon carbide, garnet, rouge, crocus and the like. The granules typically have sharp edges which act as the abrading means, but the quality and quantity of the sharp edges depends upon the utility. The granules may be embedded into or intermingled with the support backing, but, more typically are adhered to the support backing by an appropriate binder material. The granules can be applied or intermingled with the web in a specific pattern or grain or may be randomly distributed. Typically elaborate measures are taken to assure that the coated abrasive has a fixed grain with an appropriate distribution of granular cutting edges in one or more layers.

The binder material is generally any convenient material which will act to adhere the granules to the support backing and have resistance to negating the abrading process. Typical binder materials include the phenolic resins, hide glues, varnishes, epoxy resins, acrylates, multifunctional acrylates, ureaformaldehyde resins, trifunctional urethanes, polyurethane resins, lacquers, enamels and any of a wide variety of other materials which have the ability to stabilize the granules in adhering relationship to the support backing. Generally the binding material is carefully chosen to provide maximum efficiency of the coated abrasive for the abrading surface contemplated. Care is taken in selecting binder materials which can resist softening and/or burning due to overheating yet provide adequate adherency.

The granules may be sprayed or otherwise coated with the binder material and deposited on or about the support backing, or the support backing may be coated with the binder material and the granules thereafter deposited thereon. Many alternate forms of support backings, granular materials, binder materials, means of arranging the granules on the support backing, means of adhering the granules and the like are known in the prior art and are seen as variations contemplated as within the scope of this invention Generally, in the manufacture of a coated abrasive, the coating of a web of appropriate support backing with an appropriate adhesive binder and the desired granular abrasive material to form the abrasive is referred to in the prior art as the "make" coat of the coated abrasive. Thereafter, surface coatings of the thus formed coated abrasive material with various applications is typically referred to in the prior art as "sizing". The application of the first sizing coat is referred to as the "size" coat. Application of a second or further size coat to the granular side of the coated abrasive web is typically termed "oversizing" or "supersizing", while application to the non-granular side of the web is termed "backsizing".

Generally, the application of various additives occurs before or during the make coating of the abrasive. For example, it is common practice in the prior art to add waterproofing additives to the web with or before the addition of a binder. So too it is common in the prior art to incorporate anti-friction, flexibilizing, embrittling or other agents of similar type during the make coating process.

After application of the make coating the coated abrasive formed is typically dried, partially cured or otherwise treated to set or otherwise fix the granules in relative adherency to the supporting backing. Typically, after drying or partial cure, the coated abrasive is thereafter coated with a size coating containing an additional layer of adhesive, lubricants, anti-static or other grinding agents. An additional layer of granulated material may or may not be applied.

The oversizing contemplated in the instant invention is preferably done as the last or one of the last steps in the preparation of the coated abrasive after the size coat has been applied. Generally it is contemplated that the oversizing be done after the bulk coated abrasive has been assembled, dried, cured and other oversizing has been applied. It is not necessary to oversize with the compounds of the invention prior to preparation of the various forms that the coated abrasive will take, such as belts, disks and the like, but generally it is more convenient. In a preferred form wherein the coated abrasive comprises a continuous belt, the belt is actually cut and formed after the application of the oversize to assure that all portions of the surface of the belt contain adequate quantities of the oversize of the invention.

In the selection of an appropriate quaternary ammonium anti-static compound for oversizing in accord with the instant invention the preferred compounds are the fatty quaternary ammonium anti-static compounds having from about 15 to about 35 carbon atoms and a molecular weight of more than about 300. Anti-static compounds of such carbon atom content and molecular weight typically have a significant degree of lubricity, which appears to be a factor in the anti-loading performance of the coating. Such compounds must also be anti-static agents, which is to say that the Quaternary ammonium compound must be able to interact with atmosphere moisture, to modify the electrical properties of the oversize and allow electrostatic charges to be dissipated. The preferred quaternary ammonium compounds are those selected from (3-lauramidopropyl)-trimethylammonium methylsulfate, stearamidopropyl-dimethyl-$\beta$-hydroxyethylammonium nitrate, N,N-bis(2-hydroxyethyl) -N- (3'-dodecyloxy -2'- hydroxypropyl)-methyl-ammonium metho-sulfate and stearamido-propyldimethyl-$\beta$-hydroxy-ethylammonium dihydrogen phosphate. Each of these compounds are commercially available under the registered CYASTAT trademark used by Cyanamid. The most preferred compound is stearamido-propyldimethyl-β-hydroxyethylammonium nitrate, commercially sold as CYASTAT SN.

The actual formulation used as the oversize can contain various agents, diluents and the like together with an adequate quantity of the fatty quaternary ammonium anti-static compound such that the applied coating functions, alone or in combination with other agents, in both an anti-static and anti-loading capacity. Generally we have found that the oversize formulation should contain at least about 5.0 % by weight of the anti-static compound to assure adequate add-on to the coated abrasive and proper functioning of the oversize coating. Generally weight percentages can be from about 5 to saturation of the solvent system used. Applications using up to 100% solids are envisioned in this invention, but it is typically preferred to use an aqueous alcohol solvent system wherein concentrations of the compound up to saturation, e.g. about 50% solids, are readily available.

Generally, the amount of anti-static compound add-on appropriate for the oversize to perform its function varies widely, being particularly dependent upon the particular anti-static compound selected, the abrasive material comprising the coated abrasive and the grit size, with somewhat less dependence upon the binder material and the support backing. Typically, the smaller the grit size comprising the coated abrasive the less compound need be added-on. Conversely, when the grit increases in size the necessary add-on amount also increases. Generally, add-on weights from about 0.4 to about 3.0 lb. per ream, which corresponds to from about 0.6 to about 4.5 mgs per square centimeter, of coated abrasive are adequate for typical ANSI grit sizes from about 20 to about 400. The larger grit sizes of from about 36 to about 10 can accept much higher add-ons, up to about 8.0 lb. per ream, corresponding to about 11.8 mgs per square centimeter of coated abrasive. Higher add-ons can be used, however there appears to be limited advantage to anti-loading efficiencies since smearing can occur.

The following examples are provided to demonstrate the invention and are not to be considered a limitation thereof.

EXAMPLE I

Continuous belt, cotton/polyester backed phenolic binder coated abrasives were identically manufactured with 120 grit aluminum oxide granules. The control samples had no oversize coating, while the test samples were roll coated with an oversize, containing 35% by weight stearamidopropyldimethyl-β-hydroxy-ethylammonium nitrate(CYASTAT SN) in an aqueous isopropanol solution, to a dry add-on of about 1.25 pounds solids per ream(1.85 mg/sq. cm).

Comparative testing was performed in a double-sided mold continuous sanding operation, wherein opposing shaped edges of oak wood raised panel doors were sanded to equivalent finishes by two opposing, essentially identically operating, continuous belt machines fitted with dust collection systems. One of the machines was fitted with coated abrasive continuous belts comprising the controls, the opposing machine was fitted with coated abrasive belts comprising the test samples. The test was run over several days with belts being intermittently changed whenever the operator observed burning of the end grain of the panels. End grain burning is an indicator that the coated abrasive belt has become inefficient in abrading the work piece. Over the test period, the control belts lasted from 2 to 2.5 operating hours while the test sample belts lasted from 8.5 to 10.5 operating hours. The test sample belts never became so loaded with swarf as to require replacement but instead were replaced because the abrading edges of the granules became so dull as to burn the work piece. The test belts displayed excellent direction of abrading dust to the collectors. The control belts tended to spew abraded dust around the work area from the initiation of the sanding operation. Such tendency was not observed in the test sample belts even after they were so worn as to be near the end of their usable life.

EXAMPLE II

The identical coated abrasives of EXAMPLE I were comparatively tested for edge sanding application. The testing was performed using a continuous belt edge sander having a graphite covered platen for reducing heat build-up. The operator changed a belt whenever it became loaded with wood swarf and burned the workpiece. Wood swarf is a term of the art denoting an accumulation of wood particles, lignins, resins and the like on the coated abrasive. Each workpiece was of the same design and measurement. Each sanding operation of each belt was done on the same species of wood. Over the test period, the control belts lasted from 8 to 10 operating hours while the test sample belts lasted from 23 to 30 operating hours. The test sample belts never became so loaded with swarf as to require replacement but instead were replaced because the abrading edges of the granules became so dull as to burn the work piece. The test belts displayed excellent direction of abrading dust to the collectors. The control belts tended to spew abraded dust around the work are from the initiation of the sanding operation. Such tendency was not observed in the test sample belts even after they were so worn as to be near the end of their usable life.

EXAMPLE III

Continuous belt, paper backed, phenolic resin size coat over hide glue make coat binder, coated abrasives were identically manufactured with 120 grit aluminum oxide granules. The control samples had no oversize coating, while the test samples were roll coated with an oversize, containing 35% by weight stearamidopropyldimethyl-β-hydroxy-ethylammonium nitrate(CYASTAT SN) in an aqueous isopropanol solution, to a dry add-on of about 1.25 pounds solids per ream(1.85 mg/sq cm).

The coated abrasives were comparatively tested on an automatic, thru-feed stroke sander for flat panel sanding application. The testing was performed using a continuous belt thru-feed sander wherein the operator changed a belt whenever it became loaded with wood swarf and burned the workpiece. Each workpiece was of the same design and measurement. Each sanding operation of each belt was done on the same species of wood. Over the test period, the control belts lasted through completion of about 350 panels while the test sample belts lasted through completion of about 412 panels. The test belts displayed excellent direction of abrading dust to the collectors. The control belts tended to spew abraded dust around the work area from the initiation of the sanding operation. Such tendency was not observed in the test sample belts even after they were so worn as to be near the end of their usable life.

EXAMPLE IV

Identical coated abrasives of EXAMPLE I, with the exception that the control samples had a pure cotton backing, were comparatively tested for edge sanding application using a dead head platen. The testing was performed using a continuous belt edge sander having a graphite covered dead head platen for reducing heat build-up. The operator changed a belt whenever it became loaded with wood swarf and burned the workpiece. Each workpiece was of the same design and measurement. Each sanding operation of each belt was done on the same species of wood. Over the test period, the control belts lasted through 350 work piece sides while the test sample belts lasted through 700 work piece sides. The test belts displayed excellent direction of abrading dust to the collectors. The control belts tended to spew abraded dust around the work area from the initiation of the sanding operation. Such tendency was not observed in the test sample belts even after they were so worn as to be near the end of their usable life.

EXAMPLE V

Identical four and one-half inch sanding disks, having no center hole, and comprising a 100% cotton backing, phenolic resin binder, 100 grit aluminum oxide granules were prepared. The control samples had no oversize coating. Test samples were prepared comprising the above-described sanding disks, roll coat oversized with solutions containing 35% by weight of either (3-lauramidopropyl)trimethyl-ammonium methylsulfate(-CYASTAT LS), stearamidopropyldimethyl-β-hydroxyethyl-ammonium nitrate(CYASTAT SN), N,N-bis(2-hydroxy-ethyl)-N-(3'-dodecyloxy-2'-hydroxypropyl)-methylammonium methosulfate(CYASTAT 609) and stearamidopropyldimethyl-β-hydroxyethylammonium dihydrogen phosphate (CYASTAT SP) in an aqueous isopropanol solution, to a dry add-on of about 1.30 pounds solids per ream(1.93 mg/sq cm).

Each of the control and test samples were evaluated for stock removal efficiency by Schiefer testing wherein the disk is rotated for 400 revolutions at a constant speed and pressure against a one inch diameter plexiglas rod work piece. The stock removal of the control was evaluated as 100% and the stock removal of the test samples was measured and compared to the control removal. CYASTAT SN oversized disks removed 143%, LS removed 146%, SP removed 148% and CYASTAT 609 removed 149%. The 43-49% increase in stock removal efficiency was unexpectedly high. Observation of the test samples compared to the controls indicated that the controls were so severely loaded with hard packed plexiglas material at the completion of the test that they had no appreciable usable life remaining. In contrast the test samples were less severely loaded with loosely packed plexiglas material at the end of the test, which material could be easily removed by conventional means for significant extension of their useful life.

What is claimed is:

1. A coated abrasive oversized with an anti-loading amount of a quaternary ammonium anti-static compound, comprising from about 15 to about 35 carbon atoms and a molecular weight not less than about 300.

2. A coated abrasive of claim 1 wherein said quaternary ammonium anti-static compound is selected from the group consisting of (3-lauramidopropyl)trimethyl-ammonium methylsulfate, stearamidopropyldimethyl-β-hydroxyethyl-ammonium nitrate, N,N-bis(2-hydroxy-ethyl) -N-(3'-dodecyloxy-2'-hydroxypropyl)-methylammonium methosulfate and stearamidopropyl-dimethyl-β-hydroxyethylammonium dihydrogen phosphate.

3. A coated abrasive of claim 1 with an oversize comprising from about 0.4 to about 8.0 lb. per ream, of said quaternary compound.

4. A coated abrasive of claim 3 wherein the average abrasive grit size is from about 20 to about 400 and the oversize comprises from 0.4 to about 3.0 lb. per ream of said quaternary compound.

5. A coated abrasive of claim 3 wherein the average abrasive grit size is from about 10 to about 36 and the oversize comprises up to about 8.0 lb. per ream of said quaternary compound.

6. A coated abrasive of claim 1 wherein said oversize is applied in a formulation comprising from about 5% by weight up to about saturation of said quaternary ammonium compound in a solvent system.

7. A coated abrasive of claim 6 wherein said oversize is applied in a formulation comprising from about 5% to about 50% by weight quaternary ammonium compound.

8. A coated abrasive of claim 1 having an average grit size smaller than about 10.

9. A coated abrasive of claim 1 comprising a continuous belt, roll, sheet, wheel or disk.

10. A coated abrasive of claim 9 comprising a fibrous web with abrading granules distributed among the fibers.

11. A coated abrasive of claim 2 with an oversize comprising from about 0.4 to about 8.0 lb. per ream of said quaternary ammonium compound.

12. A coated abrasive of claim 11 wherein the average abrasive grit size is from about 20 to about 400 and the oversize comprises from 0.4 to about 3.0 lb. per ream of said quaternary compound.

13. A coated abrasive of claim 11 wherein the average abrasive grit size is from about 10 to about 36 and the oversize comprises up to about 8.0 lb. per ream of said quaternary compound.

14. A coated abrasive of claim 2 wherein said oversize is applied in a formulation comprising from about 5% by weight up to about saturation of said quaternary ammonium compound in a solvent system.

15. A coated abrasive of claim 14 wherein said oversize is applied in a formulation comprising from about 5 to about 50% by weight quaternary ammonium compound.

16. A coated abrasive of claim 2 having an average grit size smaller than about 10.

17. A coated abrasive of claim 2 comprising a continuous belt, roll, sheet, wheel or disk.

18. A coated abrasive of claim 17 comprising a fibrous web with abrading granules distributed among the fibers.

19. A coated abrasive of claim 2 wherein said oversize comprises stearamido-propyldimethyl-β-hydroxyethylammonium nitrate.

20. A coated abrasive of claim 19 wherein said oversize is applied in a formulation comprising from about 10 to about 50% by weight quaternary ammonium compound.

21. A coated abrasive of claim 19 with an oversize comprising from about 0.4 to about 3.0 lb. per ream of said quaternary ammonium compound.

22. A coated abrasive of claim 19 with an oversize comprising up to about 8.0 lb. per ream of said quaternary ammonium compound.

23. A method of improving the efficiency of a coated abrasive comprising applying to said coated abrasive an oversize comprising an anti-loading amount of a quaternary ammonium anti-static compound, containing from about 15 to about 35 carbon atoms and a molecular weight not less than about 300.

24. The method of claim 23 wherein said quaternary ammonium anti-static compound is selected from the group consisting of (3-lauramidopropyl)trimethylammonium methylsulfate, stearamidopropyldimethyl-β-hydroxyethyl-ammonium nitrate, N,N-bis(2-hydroxy-ethyl) -N-(3′-dodecyloxy-2′-hydroxypropyl)-methylammonium methosulfate and stearamidopropyldimethyl-β-hydroxyethylammonium dihydrogen phosphate.

25. The method of claim 23 wherein said oversize comprises from about 0.4 to about 8.0 lb. per ream of said quaternary ammonium compound.

26. The method of claim 23 wherein said oversize is applied in a formulation comprising from about 10 to about 50% by weight quaternary ammonium compound.

27. The method of claim 23 wherein the abrasive has an average grit size smaller than about 10.

28. The method of claim 23 wherein the coated abrasive comprises a continuous belt, roll, sheet, wheel or disk.

29. The method of claim 23 wherein said oversize comprises stearamido-propyldimethyl-β-hydroxyethylammonium nitrate.

* * * * *